US005120398A

United States Patent [19]

Henricson et al.

[11] Patent Number: 5,120,398

[45] Date of Patent: Jun. 9, 1992

[54] ARRANGEMENT FOR DISCHARGING PULP FROM A PULP TREATMENT APPARATUS

[75] Inventors: Kaj O. Henricson, Kotka; Olavi E. Pikka, Karhula; Toivo Niskanen, Hamina; Jukka Timperi, Kotka, all of Finland

[73] Assignee: A. Ahlstrom Corporation, Noormarkku, Finland

[21] Appl. No.: 558,143

[22] Filed: Jul. 26, 1990

Related U.S. Application Data

[63] Continuation-in-part of Ser. No. 224,467, Jul. 26, 1988, Pat. No. 4,952,314.

[30] Foreign Application Priority Data

Nov. 11, 1987 [FI] Finland ..... 874967

[51] Int. Cl.[5] ..... D21C 3/26

[52] U.S. Cl. ..... 162/18; 162/52; 162/246

[58] Field of Search ..... 162/17, 18, 52, 246, 162/380; 162/380

[56] References Cited

U.S. PATENT DOCUMENTS

| | | | |
|---|---|---|---|
| 2,616,802 | 11/1952 | Kehoe et al. | 162/18 |
| 2,723,194 | 11/1955 | Birdseye | 162/17 |
| 4,135,966 | 1/1979 | Gloersen | 162/17 |
| 4,266,413 | 5/1981 | Yli-Vakkuri | 162/380 X |
| 4,596,631 | 1/1986 | Prough et al. | 162/52 |
| 4,632,729 | 12/1986 | Laakso | 162/17 |

*Primary Examiner*—Charles Hart

*Attorney, Agent, or Firm*—Toren, McGeady & Associates

[57] ABSTRACT

An arrangement for discharging medium consistency pulp in connection with diffeent pulp treatment devices or apparatuses, the arrangement having a mass chamber, which is arranged between a screw discharging pulp from a pulp treating apparatus and a centrifugal pump transferring the pulp further so that both the screw and the pump are substantially at the same horizontal level with the pulp treatment apparatus. Thus, the presence of a drop leg having a height of several meters is prevented, whereby the centrifugal pump has no need to pump the pulp upwards back to the height of the pulp treatment apparatus.

15 Claims, 3 Drawing Sheets

ARRANGEMENT FOR DISCHARGING PULP FROM A PULP TREATMENT APPARATUS

This is a continuation-in-part application of application Ser. No. 07/224,467, filed Jul. 26, 1988 now U.S. Pat. No. 4,952,314.

BACKGROUND OF THE INVENTION

The present invention relates to an arrangement for discharging medium consistency pulp in connection with different pulp treatment devices or apparatuses. Washers used for washing pulp are disclosed below as an example.

Several types of washing apparatuses are known from the prior art. Known arrangements include diffusers, drum washers/disc washers and Fourdrinier washers, which clearly differ from each other. Pulp is fed into diffuser washers at a consistency of 10%. The feed consistency for drum washers and Fourdrinier washers is normally between 1 and 3%. Drum washers presently used are, for example, suction washers, wash presses and pressure washers.

When a conventional suction washer is used, the starting consistency of the fiber suspension in the vat is about 0.5–2%, and the consistency of the pulp layer thickened on the drum is about 10–12%.

A washer press receives the pulp at a consistency of 3 to 4%. The consistency of the washed pulp may rise even to 30%, when a press roll is used.

An example of a pressure washer is mentioned an apparatus in accordance with Finnish patent application Ser. No. 854287, published Apr. 31, 1987, now Finnish U.S. Pat. No. 71961 (corresponding U.S. application Ser. No. 921,786, filed Oct. 21, 1986), which discloses a so called drum type washer. The pulp is fed into the apparatus normally at a consistency of 3 to 6%, but in case the feed means described in the parent patent of this case or in the copending application Ser. No. 7/558,142, are used, the pulp may even be fed at a consistency of 8 to 20%. After the last washing phase the "pulp planks" are removed from the drum reaching a consistency of 15 to 17%. The washing water flowing from the compartments back on said planks, however, dilutes the consistency to 10 to 12%.

Also, disc type filters may be used for thickening or washing fiber suspensions. Their operation with respect to feed and discharge consistencies equals of pressure washers, except that a medium consistency feed for a disc filter has not yet been developed as far as a commercial product.

All these apparatuses are characterized in that the treated pulp is most often discharged from the treatment apparatus by means of allowing the pulp to drop freely along a chute into a drop leg, most often used when the treatment apparatus is substantially short, or into a trough having a screw conveyor on the bottom. The purpose of the screw conveyor is to move the pulp, often in the form of "planks", to the other end of the apparatus (the length of which may exceed 5 m) and let the pulp drop into a drop leg, the height of which may be several meters. The medium or high consistency pulp is then pumped from the bottom of the drop leg forward preferably by a fluidizing, so called MC pump (manufactured and marketed by AHLSTROM PUMPS Inc., Peace Dale, RI). It is to be noted, however, that there are some special arrangements for applying an ordinary centrifugal pump, i.e. a pump having no fluidizer, for pumping medium or high consistency pulps from a drop leg.

Thus, a characterizing feature to all prior art pulp treatment devices is the fact that the pulp is discharged into a drop leg, which is several meters high, most usually between 5 to 10 m, to ensure sufficient pressure in the suction opening of the pump for a successful pumping. Because the pulp treatment apparatuses are most usually all at the same level in a pulp mill, it has always been necessary to pump the pulp first back up from the bottom before it has been possible to feed it to the next treatment apparatus.

SUMMARY OF THE INVENTION

Accordingly, it is an object of the present invention to provide an arrangement having a mass chamber arranged between a screw and a centrifugal pump, whereby a sufficient suction head is ensured without a drop leg.

By using the discharge arrangements in accordance with the present invention, considerable savings are achieved both in the costs of the equipment and in the delivery height of the centrifugal pump compared to using the prior art discharge apparatus.

The arrangements according to the present invention are described in detail below, by way of example and with reference to the enclosed drawings, in which the treatment apparatus is shown very schematically, as their detailed structure is not relevant.

DETAILED DESCRIPTION OF THE PREFERRED EMBODIMENTS

Figure 1:
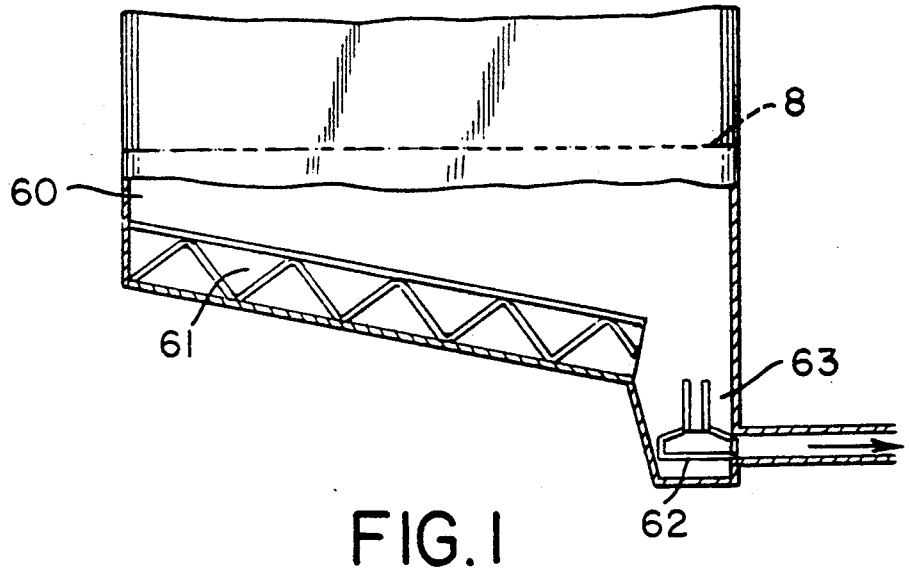
FIGS. 1 and 2 are schematic illustrations of two alternative ways for discharging pulp from a treatment apparatus.

In the arrangement according to FIG. 1, the pulp being removed from the treatment apparatus 8 falls to a chute 60. At the bottom of the chute 60 is arranged a screw feeder 61 which transfers pulp to the mass chamber or vat 63 in front of the suction duct i.e. the inlet end of a pump 62, preferably a centrifugal pump, from which vat the pump transfers the pulp for further treatment. In case the pulp in the vat is of high consistency it is advantageous to use a so-called fluidizing centrifugal pump (shown in the FIG. 1). The pump may be arranged either with its shaft in a vertical position as shown in the drawings, or with its shaft horizontally, just to mention two most appropriate ways to fasten the pump. The vat 63, in fact, corresponds to the high drop leg of the prior art apparatuses. It is, however, to be noted that the operation of the centrifugal pump has to be regulated in such a way that there is always a sufficient amount of pulp in front of the inlet opening of the centrifugal pump to prevent the pump from sucking merely air.

Figure 2:
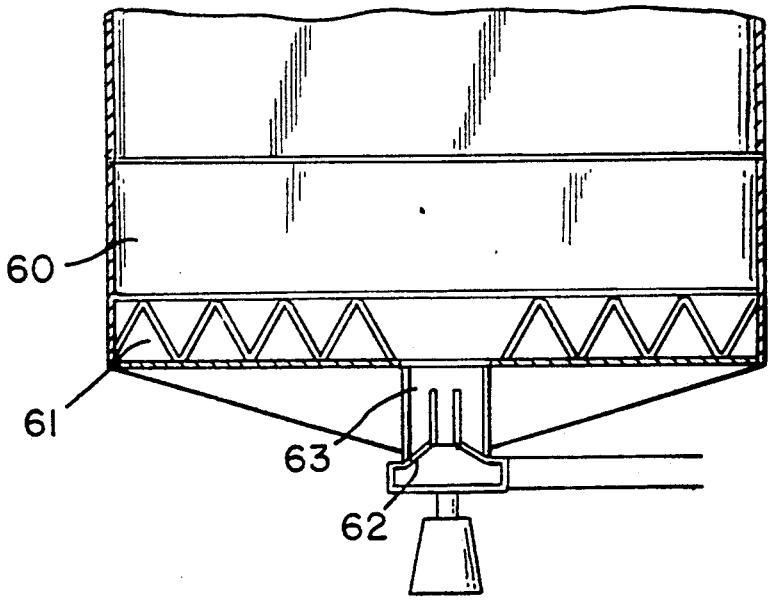

In the arrangement of FIG. 2, a pump 62 for high consistency pulp is arranged in the middle part of the apparatus, whereby the screw feeder 61 transfers pulp from the ends of the apparatus to the vat or mass chamber 63 for pump 62. Both sides of the screw feeder naturally thus transfer pulp towards the middle part of the apparatus. It is, of course, possible to replace the screw 61 of FIG. 2 with two inclined screws, which feed pulp towards the pump.

Figure 3:
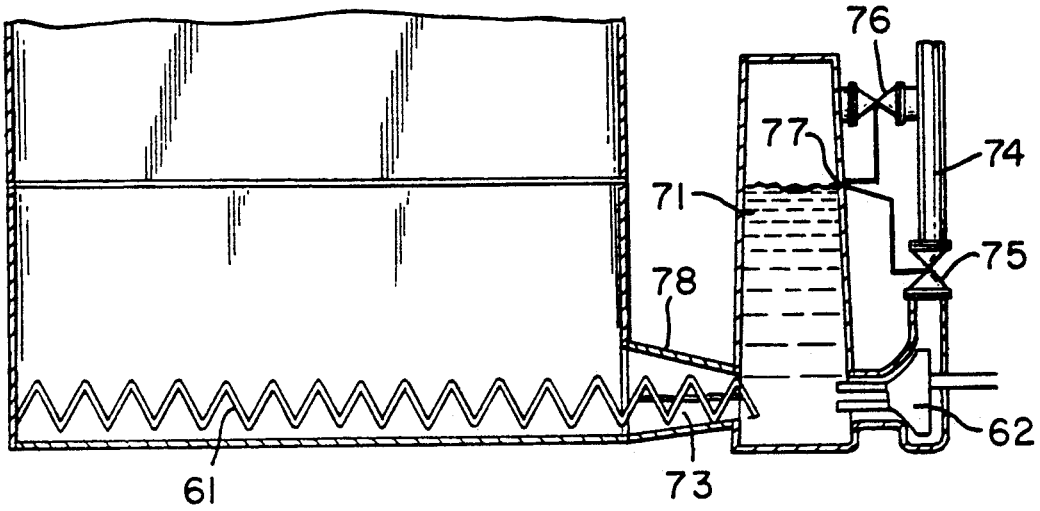
FIG. 3 is a schematic illustration of a third alternative way discharging pulp from a treatment apparatus.

FIG. 3 schematically illustrates yet another embodiment of a pulp discharge arrangement. Pulp is discharged from a treatment apparatus in an appropriate way to a chute or like, on the bottom of which there is arranged a screw 61 having a first end and a second end. The screw transfers the pulp, either horizontally or slightly inclined, to a mass chamber 71 arranged on the side of said treatment apparatus, or more specifically, transferring the pulp substantially to the bottom portion of said chamber 71 and advantageously at the substantially same horizontal level with a centrifugal pump 62, which is arranged for transferring the pulp further by means of connecting its inlet end or its inlet channel to the chamber 71. A cylindrical or advantageously slightly conical pipe portion 73 is arranged to surround the second end i.e. the discharge end of the screw 61 immediately prior to chamber 71. The purpose of the pipe portion 73 is to seal the screw 61 so as not to allow pulp to discharge itself from the chamber back towards the treatment apparatus. The pipe portion 73 may also have on its inner surface substantially axial ridges or bars 78 for preventing the pulp plug from rotating along with the screw. In case the pipe portion 73 is cylindrical or its walls are parallel with the axis of the pipe, the mass chamber end of said pipe may be provided with a flange projecting towards the axis of the pipe so as to create some back pressure towards the screw, whereby the pressure of the pulp entering the mass chamber is higher than the one due to the height of the mass in said chamber.

The arrangement of FIG. 3 needs in most applications a regulating system for maintaining a sufficient suction head in front of the pump 62. In FIG. 3 there are illustrated two alternative systems. The first being a throttling valve 75 arranged in connection with either the outlet connection or the discharge duct i.e. with the outlet end of said pump, the operation of said valve being controlled by means of impulses received from a pulp level sensor 77. The other alternative is an adjustable recirculation valve 76 controlled by the same kind of sensor 77, said valve 76 being connected to a pipe branching from the discharge duct and located between the chamber and the discharge duct 74 of the pump 62, which valve 76 also ensures the presence of a sufficient surface level of pulp, i.e. suction head in the chamber 71. Of course there are also other alternatives to arrange a sufficient suction head before the pump, i.e. control, the operation of the pump, but, as they are common knowledge to an artisan, they have not been further described.

Figure 4:
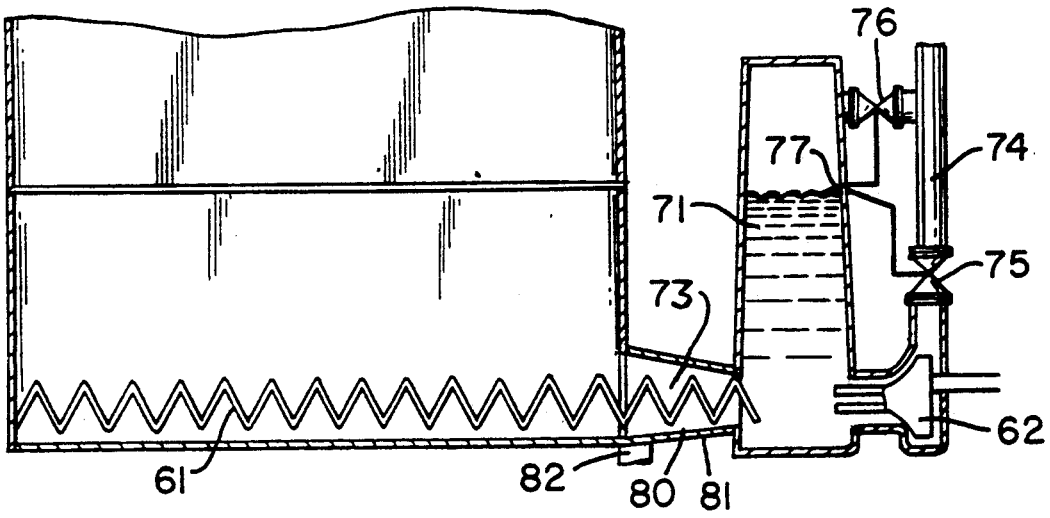
FIG. 4 is a schematic illustration of a fourth embodiment in accordance with the present invention.

One possible advantageous arrangement in accordance with FIG. 4 is to arrange a filtering surface 80 in connection with the pipe portion 73 between the apparatus and the chamber 71. In accordance with this embodiment it is also necessary that the pipe portion is conical whereby the pressure needed for efficient filtration i.e. water removal may be easily achieved. Of course the back pressure needed for filtration may also be created by a throttling arrangement similar to the flange of the embodiment of FIG. 3. The filtering surface 80 may be formed of an ordinary perforated plate, the perforations being in the form of slots, holes etc. The filtering surface may also be provided with substantially axial or perhaps somewhat inclined ridges for guiding the movement of the pulp plug advancing within the filtering surface. The major task of such ridges or bars is to prevent the plug from rotating along with the screw, whereby its axial movement towards the chamber is ensured. Between the filtering surface 80 and the pipe portion 73 there is a filtrate chamber, wherefrom the filtrate i.e. the liquid being removed from the pulp is discharged via a duct 82.

Figure 5:
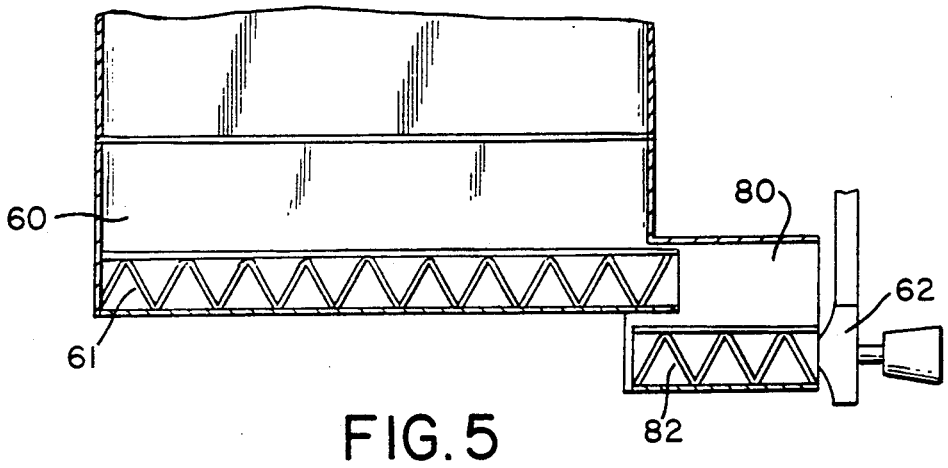
FIG. 5 is a schematic illustration of a fifth embodiment in accordance with the present invention.

Yet another preferred embodiment in accordance with the invention is shown in FIG. 5. The arrangement illustrated therein functions such that the medium or high consistency pulp is discharged from the pulp treating apparatus in a conventional manner into a chute 60 having a screw 61 on the bottom thereof. The screw 61 feeds the pulp into a mass chamber or a trough 80 located somewhat lower than the chute 60, but substantially on the same horizontal level with the pulp treating apparatus. As the pulp treating apparatus may be even 4 or 5 meters high, it is easy to arrange the trough 80 to lie on the floor beside the apparatus, whereby the height difference between the chute 60 and the trough 80 is on the order of 1–2 meters. It is an essential feature of the invention that the height difference mentioned above does not correspond to the height or the pressure due to the height of a drop leg, the height of which varies normally between 5–10 meters. The trough is provided with a screw 82 for feeding the pulp into the inlet of the pump 62. By arranging said trough as illustrated and by ensuring the feed of pulp towards the centrifugal pump in said trough, it is ensured that the centrifugal pump 62 cannot start pumping air, though the production of the pulp treatment apparatus would for some reason fluctuate. The centrifugal pump 62 may be either a so called fluidizing MC-pump or an ordinary centrifugal pump.

Figure 6:
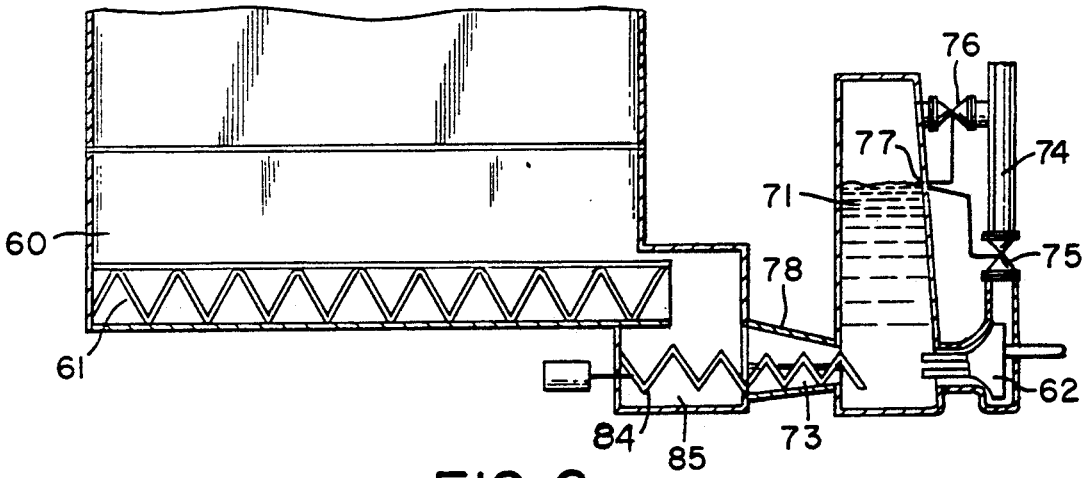
FIG. 6 illustrates an additional embodiment.

The embodiment shown in FIG. 6 has an upwardly extending chamber 71, a conical or otherwise tapering or throttled portion 73 with or without filtering means, and a trough 86. It is possible to position such a device wherever the screw on the bottom of the chute 60 feeds the pulp. Such a device may be at the end of the pulp treatment means, it may be positioned at the side thereof for instance to replace the pump 62 of FIG. 2, or it may be located at the end of the pulp treatment apparatus in such a way that the shaft of the screw feeder 84 is inclined with respect to the shaft of the screw 61. By inclining the shafts it is possible to move the screw 84 upwards almost to the same level as the screw 61.

The embodiments described above provide various advantages, which include freedom of choice in positioning the device close to the pulp treatment apparatus. An ordinary discharge chute and a corresponding screw of a pulp treatment apparatus are positioned normally about one meter above floor level. Pulp can be discharged at either the end or the side of the apparatus, or from underneath. The present invention allows use of a conventional pulp treatment apparatus which has its drop leg replaced by the invention.

In conclusion, it should be mentioned that the embodiments described above are only a modest sample of the ones being covered by the invention. Naturally, the embodiments covered by the invention may be applied to nearly all pulp treatment apparatuses or volumes, from which pulp is to be discharged at medium or high consistency.

What is claimed is:

1. An arrangement for discharging medium or high consistency pulp having a consisting of 8% to 20%, from a washer or a thickener, said arrangement comprising:

a screw having a first end for receiving the pulp form said washer or thickner and a second end for passing said pulp to a mass chamber;

a centrifugal pump having an inlet duct and an outlet duct, for further transferring said pulp; and said mass chamber arranged between said screw and said inlet duct of said centrifugal pump, said screw being connected to a bottom portion of said mass chamber.

2. The arrangement as recited in claim 1, wherein said inlet duct of said centrifugal pump is connected to a bottom portion of said mass chamber.

3. The arrangement as recited in claim 1, and further comprising a pipe portion surrounding said second end of said screw, said screw being connected to a bottom portion of said mass chamber by means of said pipe portion, and said pipe portion being provided with filtering means for dewatering said pulp.

4. The arrangement as recited in claim 1, wherein said mass chamber is provided with measuring means for determining the pulp level in said chamber, said outlet duct of said centrifugal pump being provided with means for controlling the outlet flow of pulp through said outlet duct in accordance with impulses received from said measuring means.

5. The arrangement as recited in claim 1, wherein said mass chamber is provided with measuring means for determining the pulp level in said chamber, said outlet duct of said centrifugal pump being provided with branching means for connecting the outlet duct of said pump to said mass chamber so as to recirculate some pulp back to said chamber, said branching means being provided with means for controlling the amount of pulp being recirculated in accordance with impulses received from said measuring means.

6. The measurement as recited in claim 1, wherein said centrifugal pump is a fluidizing centrifugal pump.

7. The arrangement as recited in claim 3, wherein said pipe portion has one of ribs and bars on its inner surface.

8. An arrangement for discharging medium or high consistency pulp having a consistency of 8% to 20% from a washer or a thickener, said arrangement comprising:

a screw having a first end for receiving the pulp form said washer or thickner and a second end for passing said pulp to a mass chamber;

a centrifugal pump having an inlet duct and an outlet duct for further transferring said pulp; and said mass chamber arranged between said first screw and said inlet duct of said centrifugal pump, said mass chamber being provided with a second screw on a bottom portion thereof, said second screw having a first end for receiving pulp from said first screw and a second end for feeding pulp toward said inlet duct of said pump.

9. The arrangement as recited in claim 8, wherein said second screw is arranged to feed pulp directly into said inlet duct of said pump.

10. An arrangement for discharging medium or a high consistency pulp having a consistency of 8% to 20% from a washer or a thickener, the arrangement comprising:

a screw having a first end for receiving the pulp form said washer or thickner and a second end for passing said pulp to a mass chamber;

a centrifugal pump having an inlet duct and an outlet duct for further transferring the pulp;

said mass chamber connected to said inlet duct of said centrifugal pump; and an additional mass chamber arranged between said first screw and said mass chamber, said additional mass chamber being provided with a second screw on a bottom portion thereof, said second screw having a first end for receiving pulp from said first screw and a second end for feeding pulp to said mass chamber.

11. The arrangement as recited in claim 10, and further comprising a pipe portion surrounding said second end of said second screw, said second screw being connected to the bottom portion of said additional mass chamber by means of said pipe portion, and said pipe portion being provided with filtering means for dewatering said pulp prior to feeding said pulp to said mass chamber.

12. The arrangement as recited in claim 10, wherein said mass chamber is provided with measuring means for determining the pulp level in said chamber, said outlet duct of said centrifugal pump being provided with means for controlling the outlet flow of pulp through said outlet duct in accordance with impulses received from said measuring means.

13. The arrangement as recited in claim 10, wherein said mass chamber is provided with measuring means for determining the pulp level in said chamber, said outlet duct of said centrifugal pump being provided with branching means for connecting the outlet duct of said pump to said mass chamber so as to recirculate some pulp back to said chamber, said branching means being provided with means for controlling the amount of pulp being recirculated in accordance an impulse received from said measuring means.

14. The arrangement as recited in claim 10, wherein the centrifugal pump is a fluidizing centrifugal pump.

15. The arrangement as recited in claim 11, wherein said pipe portion has one of ribs and bars on its inner surface.

* * * * *